US010524539B2

(12) United States Patent
Lo

(10) Patent No.: US 10,524,539 B2
(45) Date of Patent: Jan. 7, 2020

(54) INFLATABLE AIR PAD OF SHOE

(71) Applicant: Chih-Fang Lo, Taichung (TW)

(72) Inventor: Chih-Fang Lo, Taichung (TW)

( * ) Notice: Subject to any disclaimer, the term of this patent is extended or adjusted under 35 U.S.C. 154(b) by 136 days.

(21) Appl. No.: 15/859,737

(22) Filed: Jan. 2, 2018

(65) Prior Publication Data

US 2019/0200701 A1 Jul. 4, 2019

(51) Int. Cl.

| | |
|---|---|
| ***A43B 7/14*** | (2006.01) |
| ***A43B 13/20*** | (2006.01) |
| ***A43B 13/18*** | (2006.01) |
| ***A43B 13/12*** | (2006.01) |

(52) U.S. Cl.

CPC ..... *A43B 13/203* (2013.01); *A43B 7/149* (2013.01); *A43B 13/12* (2013.01); *A43B 13/186* (2013.01)

(58) Field of Classification Search

CPC ..... A43B 3/203; A43B 3/20; A43B 3/206; A43B 3/38

USPC ..... 36/93

See application file for complete search history.

(56) References Cited

U.S. PATENT DOCUMENTS

| | | | | |
|---|---|---|---|---|
| 4,312,140 A * | 1/1982 | Reber | A43B 13/206 36/3 B |
| 8,555,526 B2 * | 10/2013 | Elnekaveh | A43B 1/0054 36/103 |
| 2011/0265347 A1 * | 11/2011 | Leary | A42C 2/007 36/93 |
| 2015/0305436 A1 * | 10/2015 | Doyle | A43B 13/203 36/43 |

* cited by examiner

*Primary Examiner* — Timothy K Trieu

(57) ABSTRACT

A shoe includes an outsole having a room defined in the top thereof. A vamp is connected to the peripheral wall of the room. An air pad and an insole are located in the room. The air pad includes a front pad and a rear pad. A tube is connected between the front and rear pads. The front pad includes an inflatable support portion and a resilient support section which is located at the front portion of the front pad. The resilient support section has multiple buffering portions. A plate is located on the front pad and between the inflatable support portion and the insole. The plate restricts the deformation area on the inflatable support portion to deform the insole.

5 Claims, 9 Drawing Sheets

INFLATABLE AIR PAD OF SHOE

BACKGROUND OF THE INVENTION

1. Fields of the Invention

The present invention relates to an inflatable air pad for a shoe, and more particularly, to an inflatable air pad that provides features of comfort and protection to the wearers.

2. Descriptions of Related Art

The conventional air pad for a shoe is disclosed in FIG. 9 and generally comprises an air cell 71 on the outsole 70 which is connected to the inside of the vamp 72 so as to form a space for accommodating the wearer's foot 80. An insole 73 is located in the space and covers on the air cell 71. The insole 73 and the air cell 71 absorb shocks transferred from the ground so as to protect the wearer's foot 80. The air cell 71 includes a tube 711 connected thereto which is connected to a valve (not shown). The air cell 71 is inflated by introducing air into the air cell 71 via the tube 711 to achieve the purposes mentioned above.

However, when the air cell 71 inflates, there is a deformation formed on the top of the air cell 71 due to the soft material of the air cell 71, and the deformation area is small so that the deformation area becomes a protruded portion that contacts the foot 80 during running. Therefore, the underside of the foot 80 is stimulated and ground by the deformation area of the air cell 71. This stimulation becomes a problem especially when the wearer runs a long distance such as in a marathon competition. The fore portion of the foot steps on the deformation area frequently may cause injury and/or unbalance.

The present invention intends to provide an inflatable air pad for a shoe to eliminate the shortcomings mentioned above.

SUMMARY OF THE INVENTION

The present invention relates to a shoe which comprises an outsole having a room defined in the top thereof. A vamp is connected to the peripheral wall of the room. An air pad and an insole are located in the room. The air pad includes a front pad and a rear pad. A tube is connected between the front and rear pads. The front pad includes an inflatable support portion and a resilient support section which is located at the front portion of the front pad. The resilient support section has multiple buffering portions. A plate is located on the front pad and between the inflatable support portion and the insole. The plate restricts the deformation area on the inflatable support portion to deform the insole.

Preferably, the plate is secured to the top surface of the inflatable support portion of the front pad.

Preferably, the plate is secured to an inside of the peripheral wall of the room.

Preferably, the plate is secured to an underside of the insole.

Preferably, the thickness of the plate is smaller than half of the thickness of the insole.

Preferably, the plate is made of carbon-fiber and has glue spread thereon so as to secure the plate to the inflatable support portion of the front pad and the insole.

Preferably, the front pad includes a buffering foam received therein.

Preferably, the air pad includes a rear pad and a tube which is connected in communication between the front pad and the rear pad. The tube is connected with an inflation valve and a release valve, wherein the inflation valve inflates the front and rear pads. The release valve includes a pre-set pressure value and releases pressure from the front pad when the pressure in the front pad reaches the pre-set pressure value.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
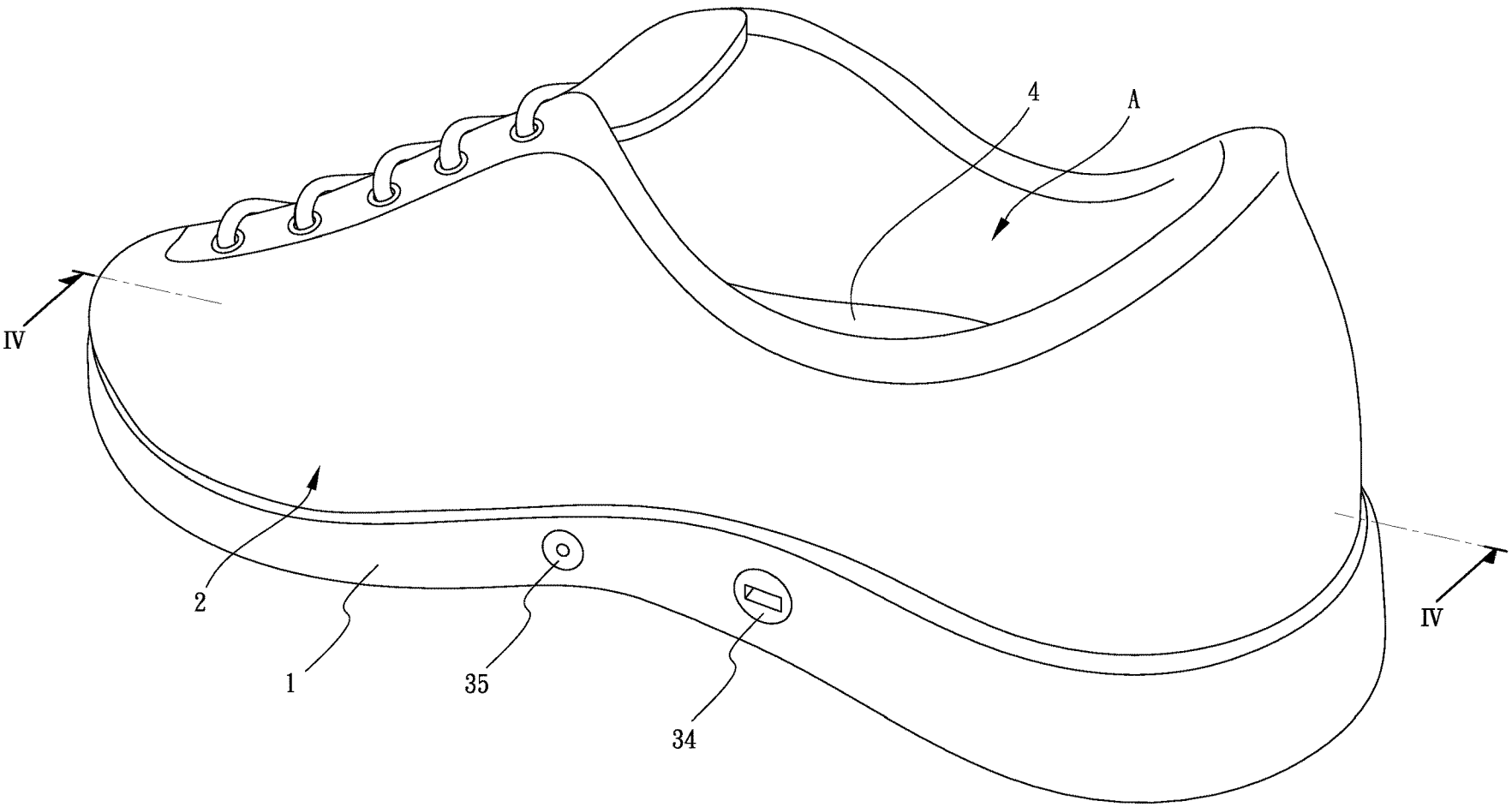
FIG. 1 is a perspective view to show the shoe of the present invention.
Figure 2:
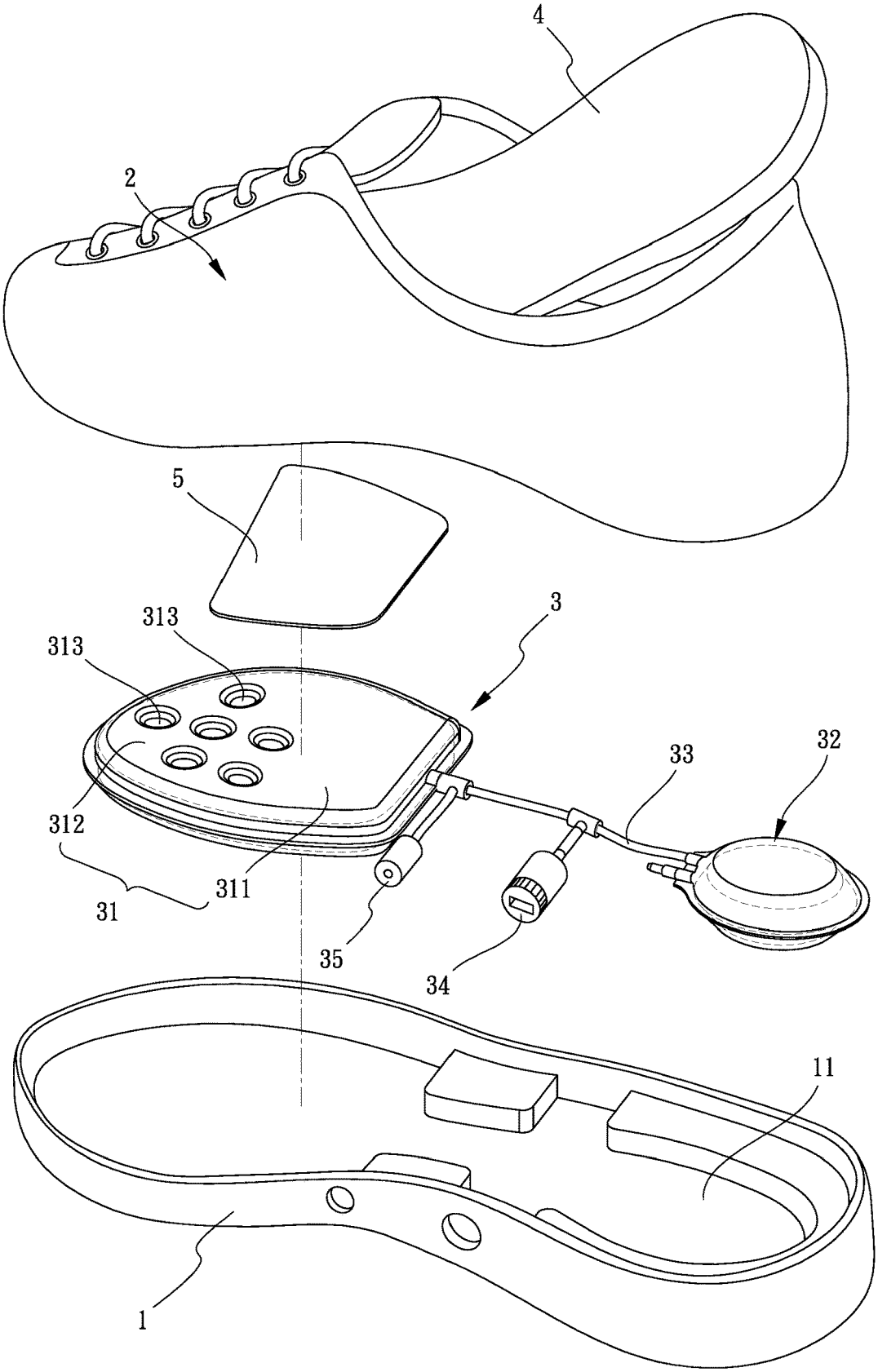
FIG. 2 is an exploded view of the shoe of the present invention.
Figure 3:
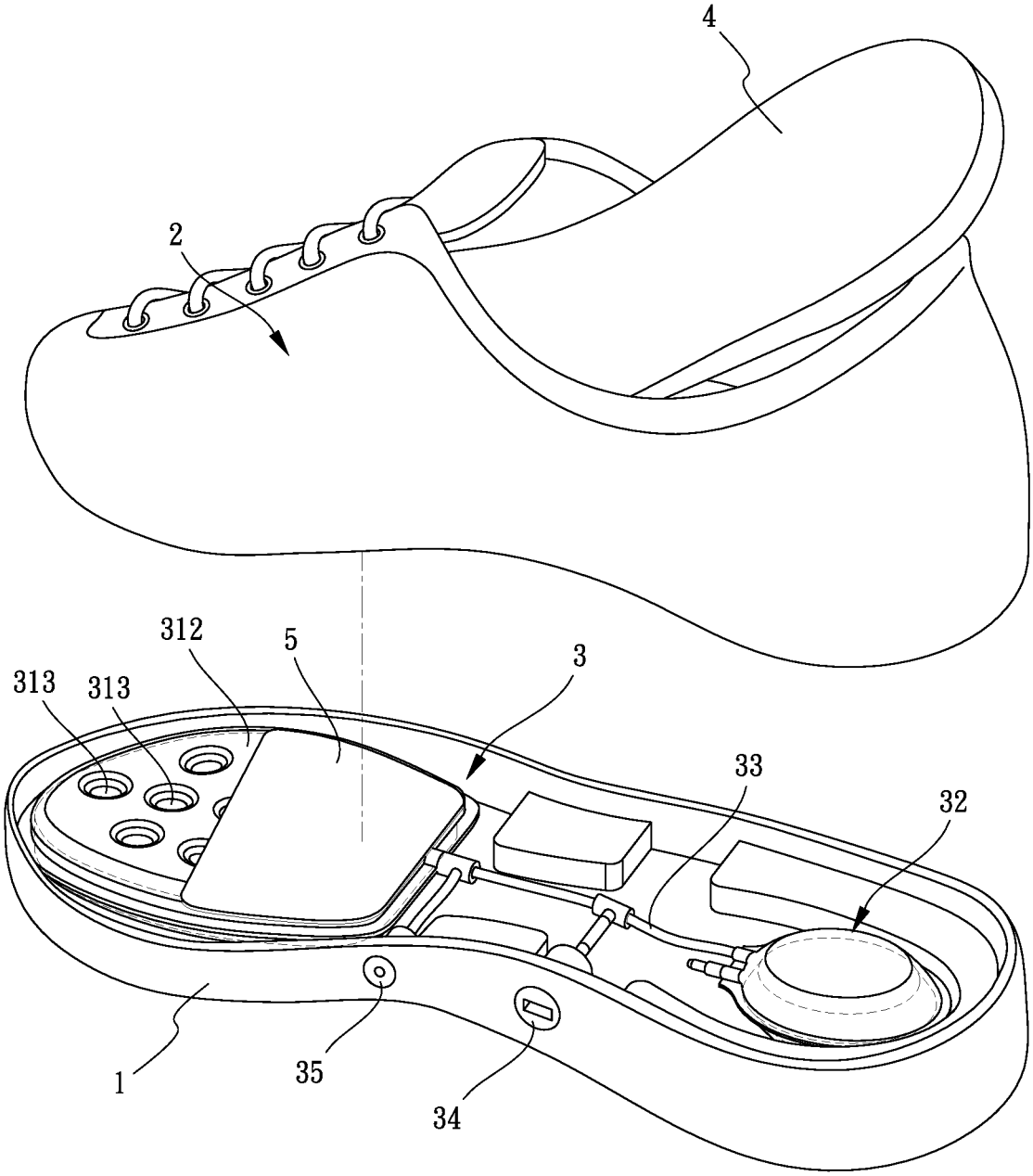
FIG. 3 shows another exploded view of the shoe of the present invention.
Figure 4:
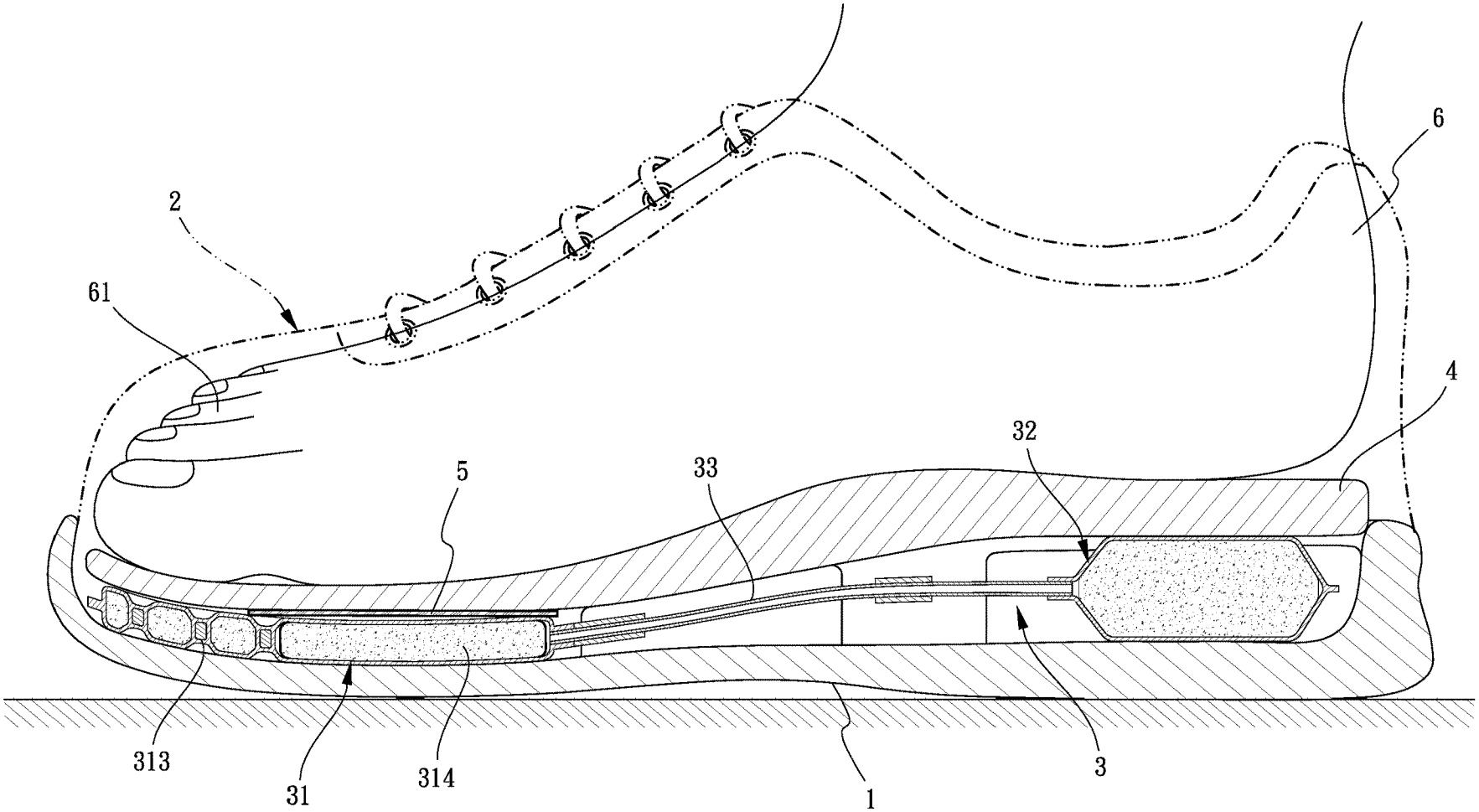
FIG. 4 is a cross sectional view taken along line IV-IV in FIG. 1.
Figure 5:
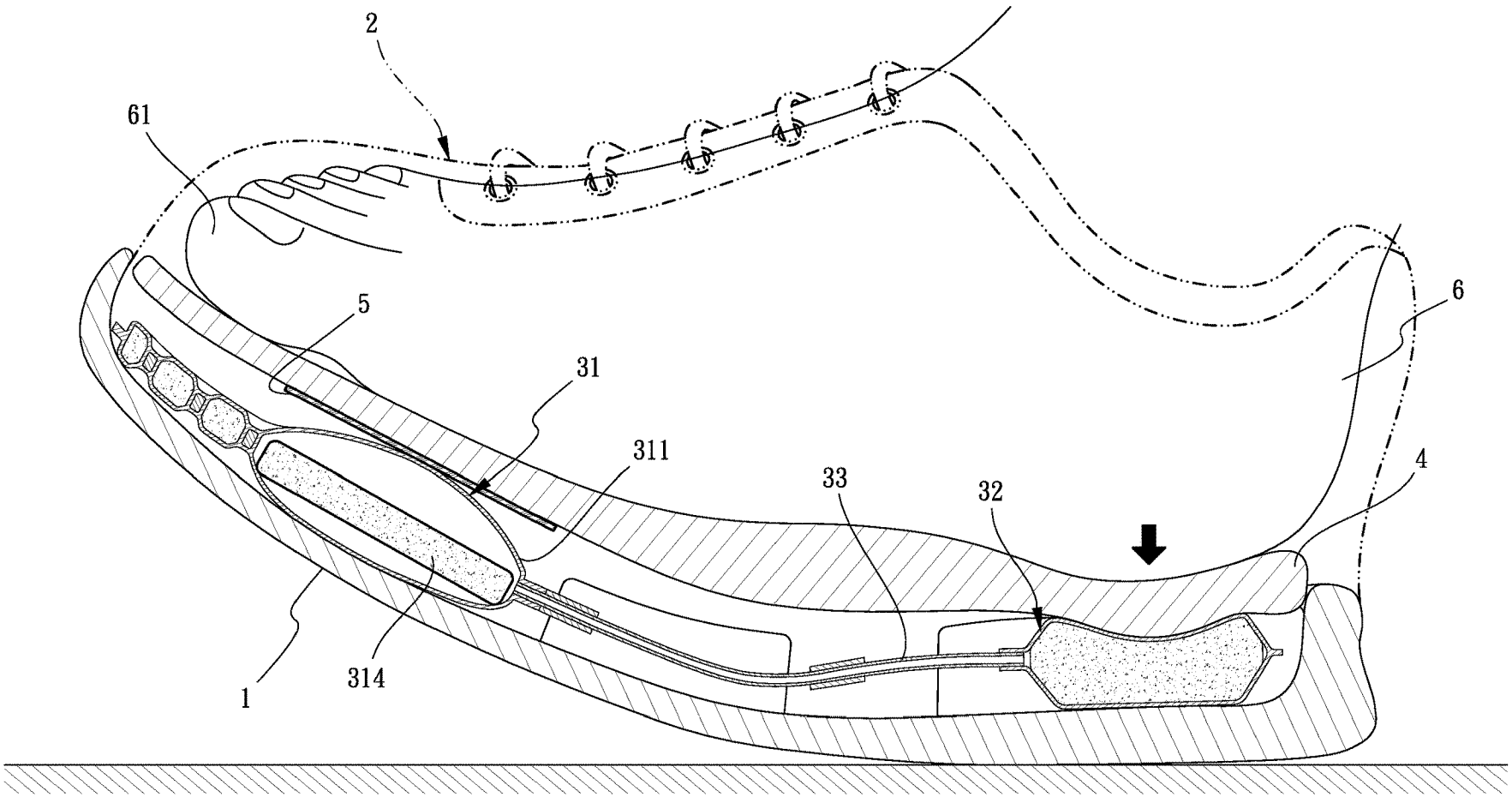
FIG. 5 is a cross sectional view to show when the heel of the wearer's foot contacts the ground.

Referring to FIGS. 1 to 8, the shoe of the present invention comprises an outsole 1 having a room 11 defined in the top thereof and a vamp 2 is connected to the peripheral wall of the room 11. An air pad 3 and an insole 4 are received in the room 11. The insole 4 is and put on the air pad 3. The air pad 3 includes a front pad 31 and a rear pad 32, and a tube 33 33 is connected in communication between the front pad 31 and the rear pad 32. A space "A" is defined between the vamp 2 and the insole 4 so that the foot 6 of the wearer is accommodated in the space "A".

The tube 33 is connected with an inflation valve 34 and a release valve 35. The inflation valve 34 is able to be accessed from one side of the outsole 1 and introduces air to inflate the front and rear pads 31, 32. The release valve 35 communicates with outside of the outsole 1 and includes a pre-set pressure value and releases pressure from the front pad 31 when a pressure in the front pad 31 reaches the pre-set pressure value.

The front pad 31 is located in the front portion of the room 11, and includes an inflatable support portion 311 and a resilient support section 312 which is located at the front portion of the front pad 31. The resilient support section 312 has multiple buffering portions 313 which are located corresponding to the toes 61 of the foot 6. The front pad 31 further includes a buffering foam 314 received therein.

A plate 5 is located on the front pad 31 and between the inflatable support portion 311 and the insole 4. The plate 5 is made of carbon-fiber and has glue spread thereon so as to secure the plate 5 to the inflatable support portion 311 of the front pad 31 and the insole 4. Specifically, the plate 5 is secured to the top surface of the inflatable support portion 311 of the front pad 31, the inside of the peripheral wall of the room 11, and the underside of the insole 4. Preferably, the thickness of the plate 5 is smaller than a half of the thickness of the insole 4.

Figure 6:
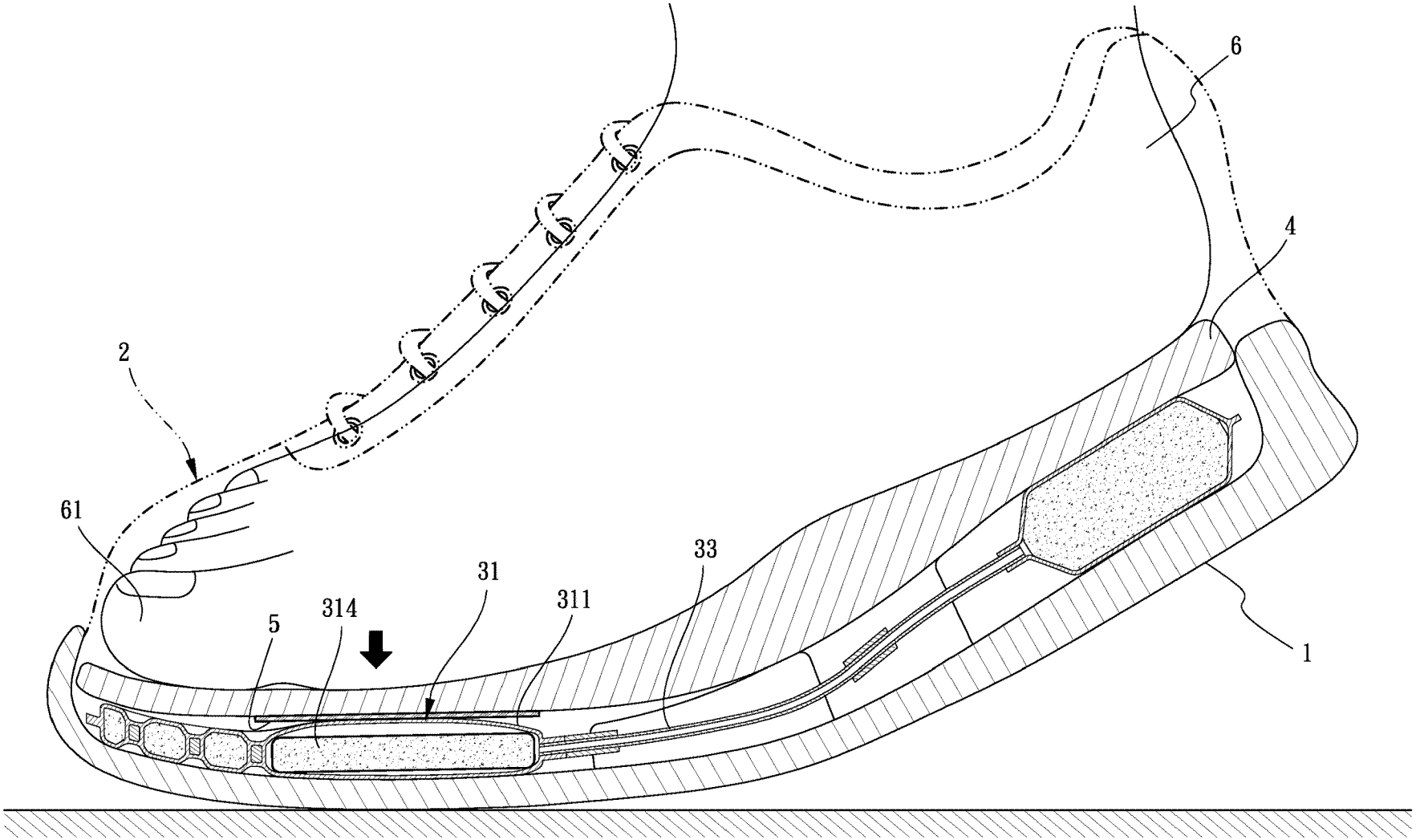
FIG. 6 is a cross sectional view to show that when the weight center of the wearer is shifted from the heel to the front portion of the wearer's foot.
Figure 7:
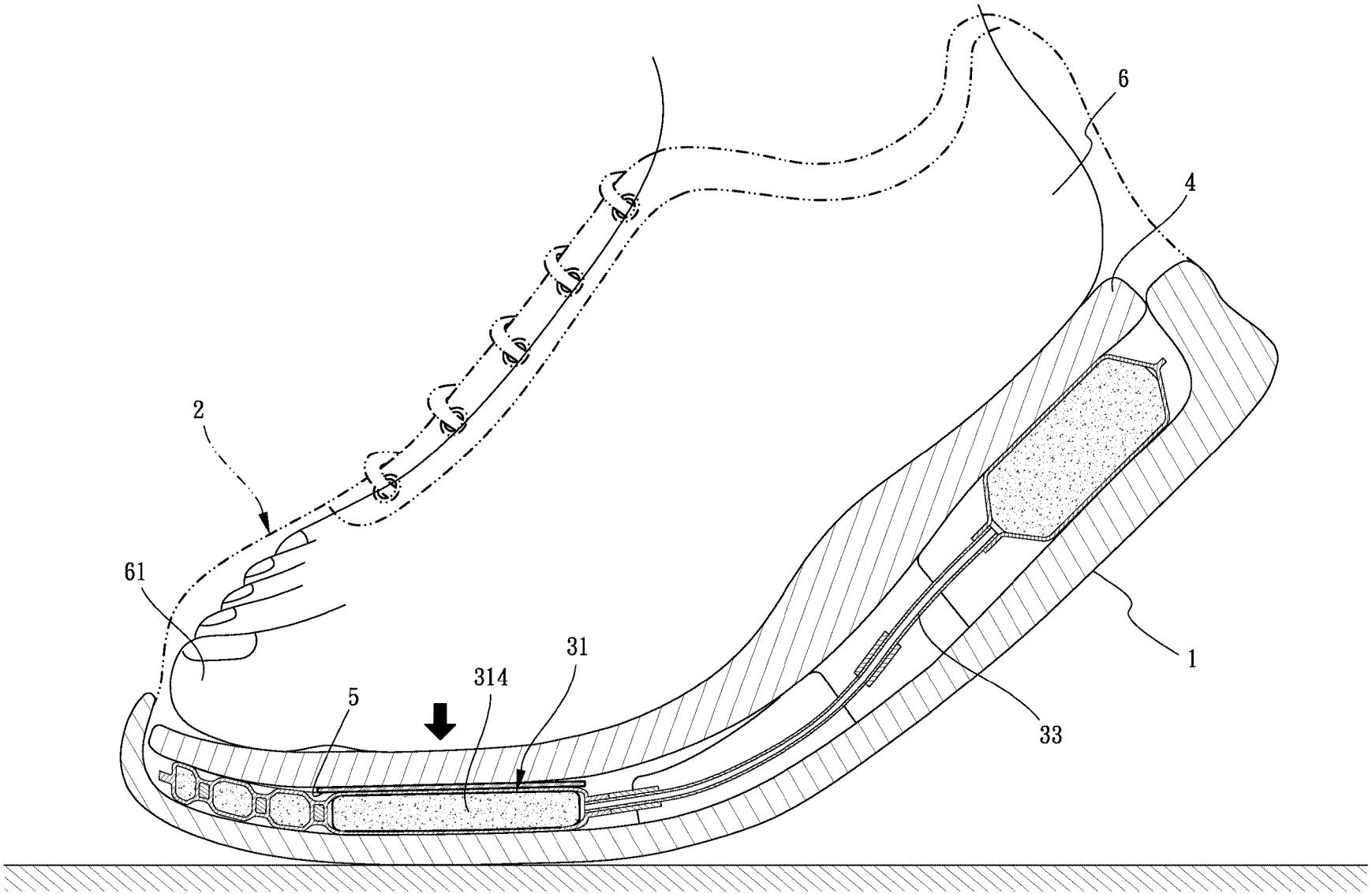
FIG. 7 shows that the wearer is running and the front portion of the wearer's foot contacts the ground to compress the front pad.
Figure 8:
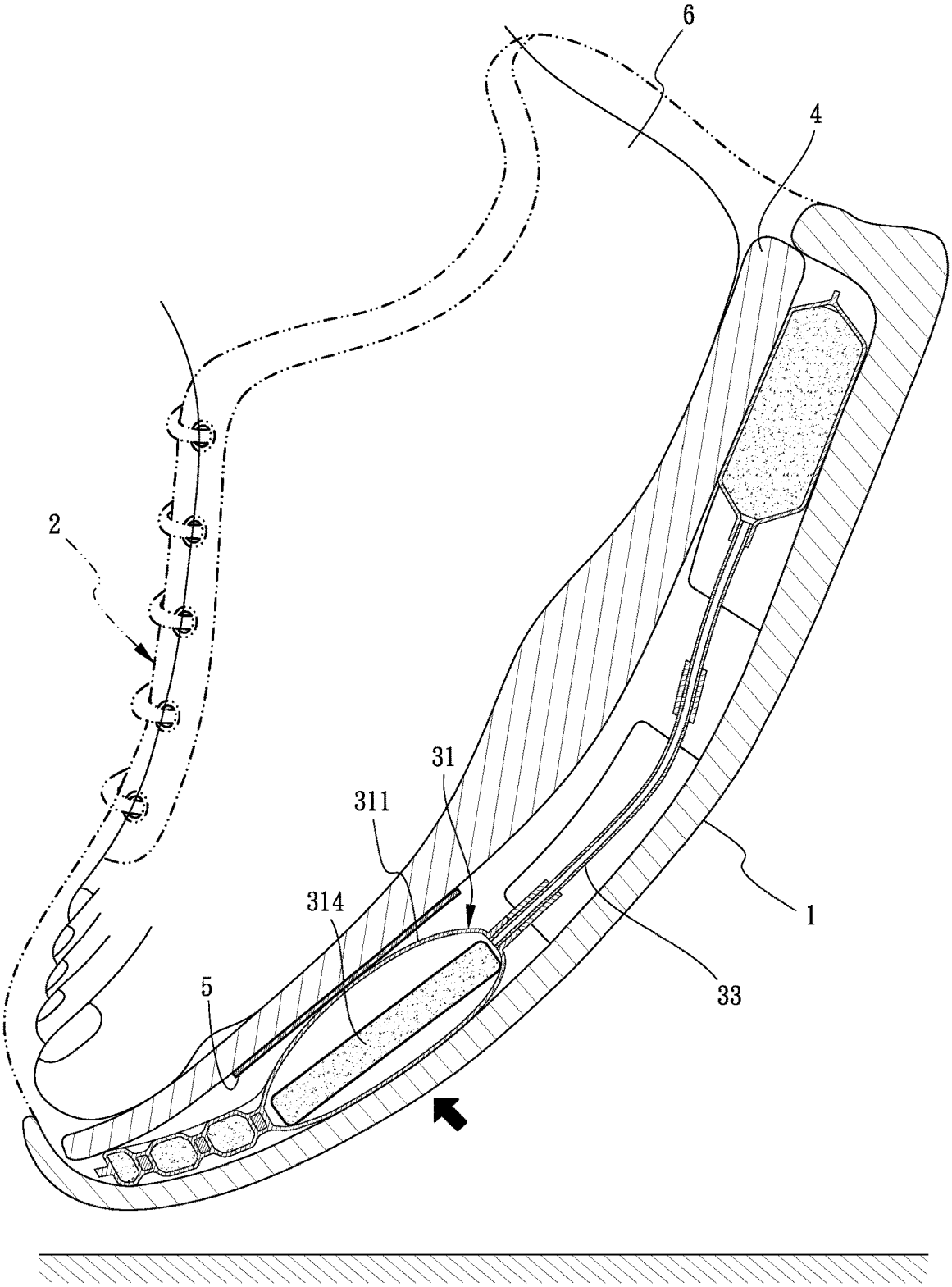
FIG. 8 shows that the wearer is running and the front portion of the wearer's foot leaves from the ground and the front pad bounces back.
Figure 9:
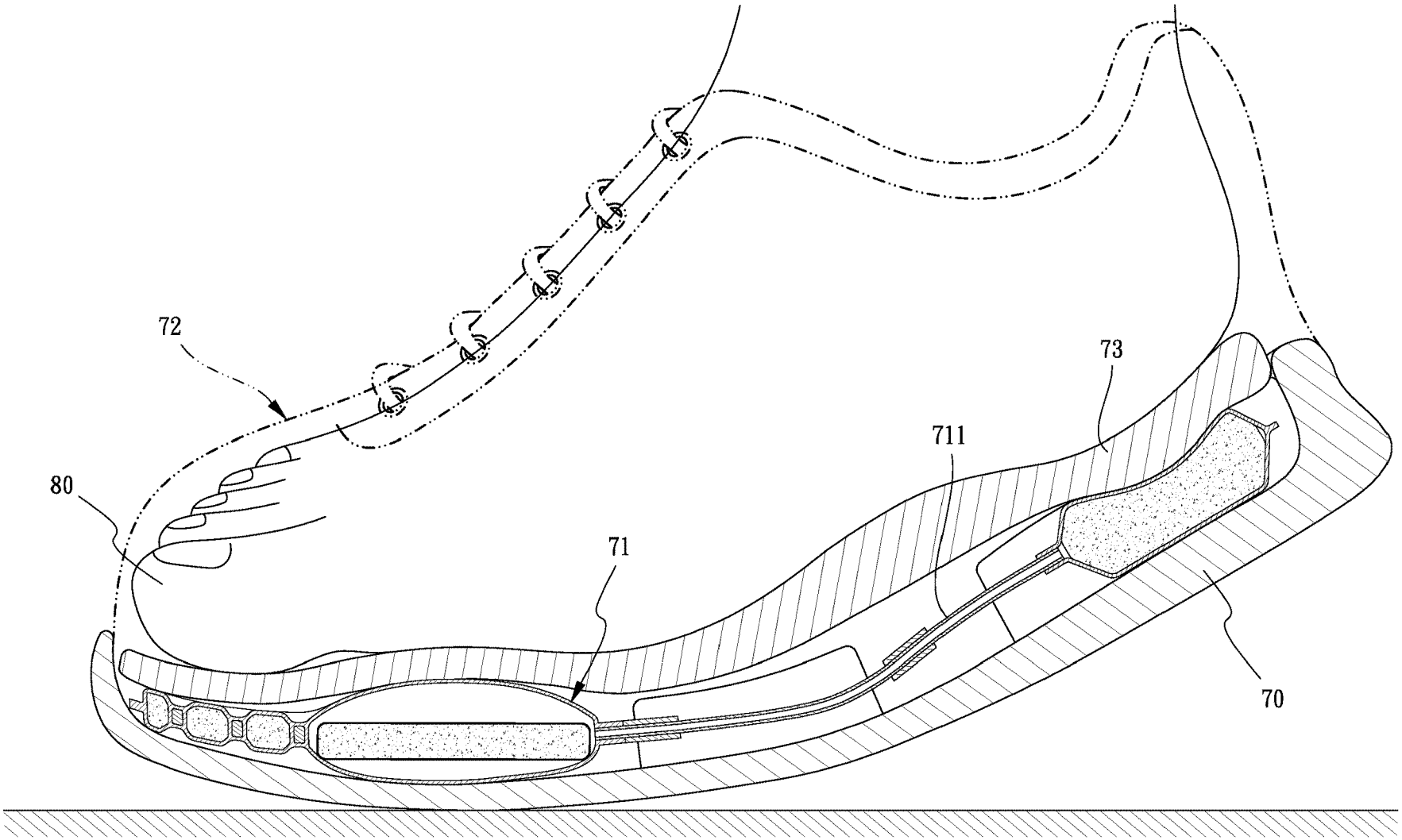
FIG. 9 is a cross sectional view to show the conventional shoe.

As shown in FIGS. 3 to 8, the wearer inflate the front and rear pads 31, 32 by the inflation valve 34 before wearing the shoe. When the wearer runs with the shoes, the heel 6 contacts the ground, the weight of the wearer compresses the rear pad 32, and the air in the rear pad 32 flows to the front pad 31 via the tube 33 to inflate the inflatable support portion 311. As shown in FIG. 6, when the weight center of the wearer is shifted to the front of the shoe, the front pad 31 is compressed to compress the front pad 31 as shown in FIG. 7. Then the shoe leaves the ground and the front pad 31 bounces back.

The plate 5 has a certain level of stiffness so as to restrict the deformation area on the inflatable support portion 311 when the from pad 31 is compressed, such that the front portion of the foot 6 of the wearer is protected from being injured by the deformation area of the inflatable support portion 311.

The advantages of the present invention are that the plate 5 located between the front pad 31 and the insole 4 prevents the deformation area on the inflatable support portion 311 to overly scrub the front portion of the foot 6 of the wearer. Therefore, the wearer feel comfortable and can perform as expected.

While we have shown and described the embodiment in accordance with the present invention, it should be clear to those skilled in the art that further embodiments may be made without departing from the scope of the present invention.

What is claimed is:

1. A shoe comprising:

an outsole having a room defined in a top thereof and an air pad located in the room, a vamp connected to a peripheral wall of the room, an insole and the air pad located in the room, the air pad including a front pad and a rear pad, a tube connected in communication between the front pad and the rear pad, the front pad located in a front portion of the room, the front pad including an inflatable support portion and a resilient support section which is located at a front portion of the front pad, the front pad including a buffering foam received therein, the resilient support section having multiple buffering portions, the tube connected with an inflation valve and a release valve, the inflation valve inflating the front and rear pads, the release valve including a pre-set pressure value and releasing pressure from the front pad when a pressure in the front pad reaches the pre-set pressure value, and a plate located on the front pad and between the inflatable support portion and the insole, the plate being made of carbon-fiber and having glue spread thereon so as to secure the plate to the inflatable support portion of the front pad and the insole, the plate restricting a deformation area on the inflatable support portion to deform the insole.

2. The shoe as claimed in claim 1, wherein the plate is secured to a top surface of the inflatable support portion of the front pad.

3. The shoe as claimed in claim 1, wherein the plate is secured to an inside of the peripheral wall of the room.

4. The shoe as claimed in claim 1, wherein the plate is secured to an underside of the insole.

5. The shoe as claimed in claim 4, wherein a thickness of the plate is smaller than a half of a thickness of the insole.

* * * * *